United States Patent [19]

Gregory

[11] Patent Number: 4,673,060

[45] Date of Patent: Jun. 16, 1987

[54] FOLDABLE SCAFFOLD AND METHOD

[76] Inventor: Robert K. Gregory, 1110 Eikel, Suite E, New Braunfels, Tex. 78130

[21] Appl. No.: 831,367

[22] Filed: Feb. 18, 1986

[51] Int. Cl.[4] ..... E04G 3/14; E04G 5/06

[52] U.S. Cl. ..... 182/82; 182/152; 182/113; 248/240

[58] Field of Search ..... 182/82, 152, 113, 155, 182/62, 61; 248/235, 240

[56] References Cited

U.S. PATENT DOCUMENTS

| | | | |
|---|---|---|---|
| Re. 13,036 | 11/1909 | Humphries | 182/82 |
| 1,666,410 | 4/1928 | Dalton | 248/238 |
| 2,414,538 | 1/1947 | Lamb | 182/113 |
| 2,882,101 | 4/1959 | Michalak | 182/82 |
| 4,014,404 | 3/1977 | Jackson | 182/155 |

FOREIGN PATENT DOCUMENTS

| | | | |
|---|---|---|---|
| 106352 | 5/1927 | Austria | 248/240 |
| 668599 | 12/1938 | Fed. Rep. of Germany | 182/82 |
| 663788 | 4/1929 | France | 248/240 |

*Primary Examiner*—Reinaldo P. Machado
*Attorney, Agent, or Firm*—Cox & Smith Inc.

[57] ABSTRACT

A foldable scaffold which can be erected to the side of a scaffold anchor having a horizontal member pivotally mounted at one end to the scaffold anchor and a support member pivotally mounted at one end to the horizontal member and the other end releasably mounted on the support anchor. A pin is provided for selectively holding the horizontal member in a first horizontal position and for releasing the horizontal member from that first horizontal position to allow the horizontal member and the support member to pivot to a second position in which the horizontal and support members are closely approximated with the scaffold anchor. If, for instance, the scaffold anchor is a gangform, the disassembly, storage, transport and re-assembly of the gangform is greatly facilitated by the fact that the scaffold is folded and re-erected by merely inserting two pins into the horizontal member and support member.

10 Claims, 4 Drawing Figures

FOLDABLE SCAFFOLD AND METHOD

BACKGROUND OF THE INVENTION

The present invention relates to a foldable scaffold. More particularly, the present invention relates to a scaffold which can be selectively folded to lay flat against the side of a scaffold anchor, as well as to fold-up flat for shipping and storing.

Scaffolds are widely used on concrete forms because it is often the case that the forms are so tall a scaffold must be set up to adjust, assemble or disassemble the forms. Particularly with gangforms for pouring concrete walls, it is necessary to climb up on the side of the form to direct the flow of concrete and assemble the form.

Prior art scaffolds are known which are free standing structures erected on the ground adjacent the structure for which the scaffolds are needed. Some prior art form scaffolds are known which are fixed to the structure for which the scaffolds are needed, however this type of scaffold is generally rigidly fixed to the side of the structure or must be fastened and removed as one rigid piece, if it is removable at all.

When a scaffold is fixed to the side of a structure, it hinders the mobility of the structure. For example, if a scaffold is attached to a gangform and it is desired to move the gangform to another area to pour another wall, it would be advantageous if the scaffold could be folded rather than removed to facilitate transporting the gangform as well as the scaffold to another location and to avoid damage to the scaffold.

Another disadvantage of the prior art is that scaffolds are generally made of materials which are customized for use in a scaffold or are attached to the scaffold anchor in such a way that they cannot be disassembled and reused. For example, metal form scaffolds are generally made of specially sized metal members which are not adapted for use on wood concrete forms or trusses. Lumber scaffolds must be nailed together, so that prying the scaffold apart damages the lumber and limits its potential for reuse. Thus, it is an object of the present invention to provide a scaffold which can be assembled and disassembled conveniently and quickly and which can be folded flat against the structure, or scaffold anchor, on which it is mounted.

It is another object of the present invention to provide a foldable scaffold comprising a scaffold anchor, a horizontal member pivotally mounted at one end to the scaffold anchor, a support member pivotally mounted at one end to the horizontal member and releasably mounted to the scaffold anchor at the other end, and means for selectively holding the horizontal member in a substantially horizontal position and for releasing the horizontal member to allow the horizontal member and the support member to pivot into close approximation with the scaffold anchor.

It is another object of the present invention to provide a scaffold mounted to the side of the structure for which the scaffold is needed.

It is a further object of the present invention to provide a scaffold which can be folded or easily removed from a gangform.

It is a further object of the present invention to provide a foldable scaffold that is folded compactly for storing and shipping.

It is a further object of the present invention to provide a foldable scaffold that folds without removing either the guard rails or scaffold planks.

It is a further object of the present invention to provide a foldable scaffold adaptable to be mounted on gangforms and on other structures used in construction.

It is a further object of the present invention to provide a foldable scaffold which is durable and has a long life span.

These and other objects of the present invention are will be evident to those skilled in the art from the following description of the invention.

SUMMARY OF THE INVENTION

These objects and advantages are provided by a foldable scaffold comprising a scaffold anchor, a horizontal member pivotally mounted at one end to the scaffold anchor, and a support member pivotally mounted at the other end to the horizontal member and releasably mounted at the other end to the scaffold anchor. Means is provided for selectively holding the horizontal member in a first horizontal position and for releasing the horizontal member from the first position to allow the horizontal member and the support member to pivot to a second position in which the horizontal member and the support member are closely approximated with the scaffold anchor.

The present invention is also directed to a method for folding a scaffold comprising pivotally mounting a horizontal member to a scaffold anchor, supporting the horizontal member with a support member pivotally mounted to the horizontal member at one end and releasably mounted to the scaffold anchor at the other end, locking the horizontal member and the support member in a predetermined angle whereby the horizontal member is substantially horizontal and the support member is mounted to the scaffold anchor, removing a pin to unlock the angle and to release the support member, and pivoting the horizontal member and the support member to a position in which the horizontal member and the support member are closely approximated with the scaffold anchor.

DESCRIPTION OF THE PREFERRED EMBODIMENT

Figure 1:
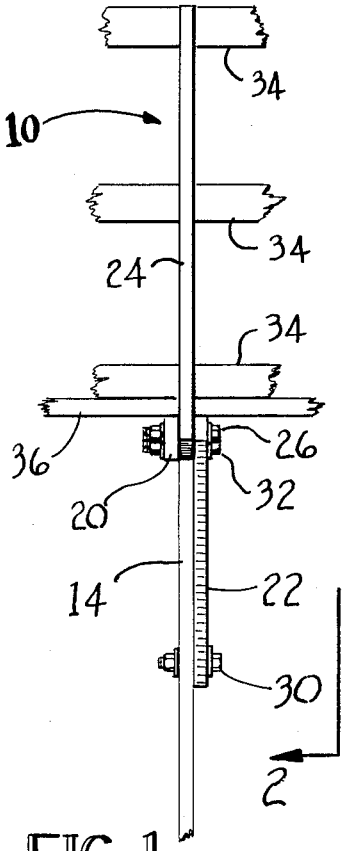
FIG. 1 is a side elevational view of a portion of a scaffold constructed according to the teachings of the present invention.

The foldable scaffold of the present invention, labeled generally as 10, is shown in FIGS. 1-4. The foldable scaffold 10 is shown mounted to a scaffold anchor in the form of a gangform 12. In the portion of the gangform 12 shown in FIG. 2, there is shown a stud 14 and facing 16. The stud 14, in a presently preferred embodiment, is provided with a plurality of holes 18 spaced along the length thereof, the function of which will be evident from the following explanation. However, it is understood the scaffold 10 could be attached to any structure which could serve as a scaffold anchor.

Figure 2:
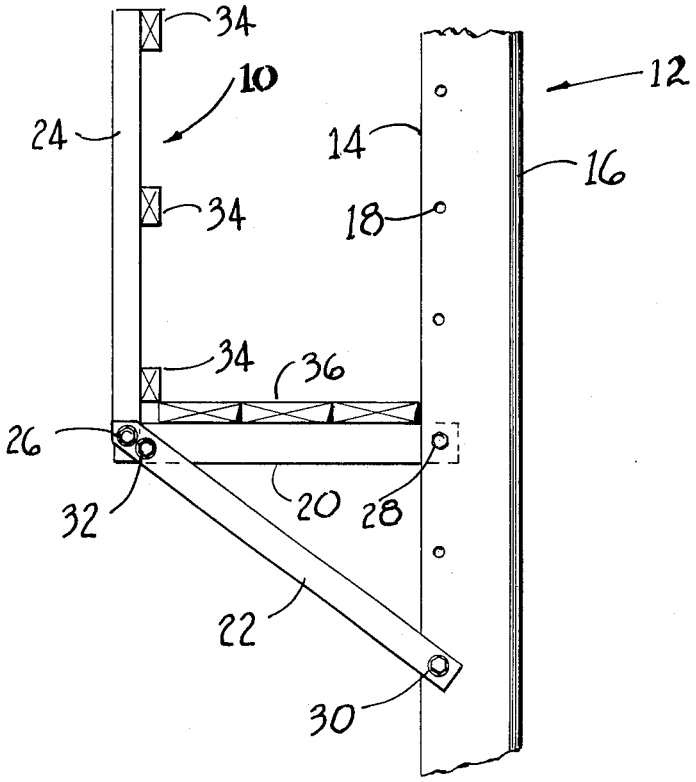
FIG. 2 is an end elevational view of the scaffold of FIG. 1.
Figure 3:
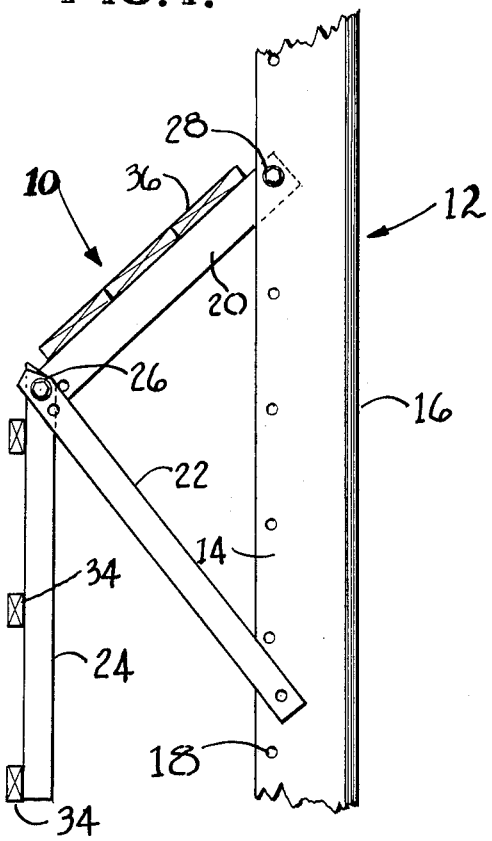
FIG. 3 is an end elevational view of the scaffold of FIG. 1 in the process of being folded.
Figure 4:
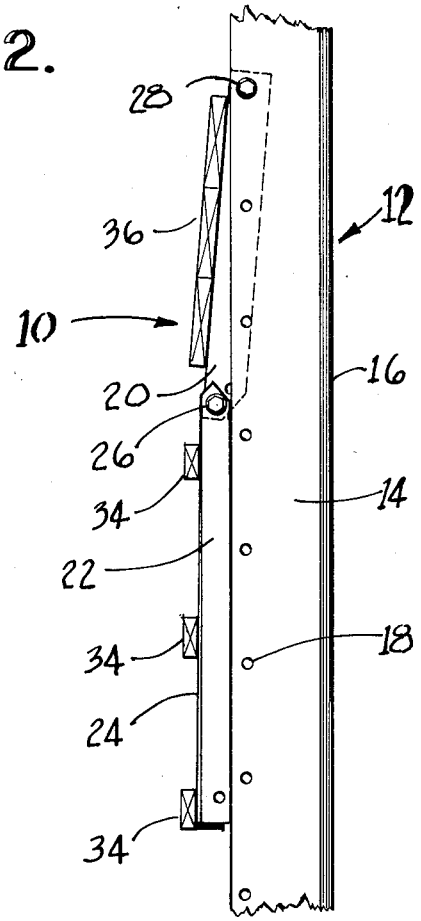
FIG. 4 is an end elevational view of the scaffold of FIG. 1 in close approximation with the scaffold anchor.

The scaffold 10 is comprised of a horizontal member 20, a support member 22 and a rail post 24. As is shown in FIGS. 2, 3 and 4, horizontal member 20, support member 22, and rail post 24, are pivotally mounted to each other by bolt 26. The horizontal member 20 is pivotally mounted to stud 14 by bolt 28 in hole 18 in stud 14. Both bolts 26 and 28 are tightened snugly, but not so tight as to prevent horizontal member 20, support member 22 and rail post 24 from pivoting with respect to each other. The support member 22 is releasably mounted to another of the holes 18 on the stud 14 by a third bolt 30.

The scaffold 10 is held in a first position in which the horizontal member 20 is substantially horizontal as shown in FIGS. 1 and 2 by a releasable pin member 32 through the holes (not numbered) in support member 22 and horizontal member 20, but not passing through the rail post 24. The holes into which releasable pin member 32 is inserted are located in close proximity to the rail post 24, so that when the holes in horizontal member 20 and support member 22 are aligned and the releasable pin member 32 is inserted, as shown in FIG. 2, releasable pin member 32 will bear against the side surface 33 of the rail post 24 to prevent the rail post 24 from pivoting, thereby holding the rail post 24 in a substantially vertical position. The releasable pin member 32 also holds the horizontal member 20 and support member 22 at a predetermined angle relative to each other.

It will be understood by those skilled in the art who have the benefit of this disclosure that bolts 26, 28 and 30, and releasable member 32 all serve similar functions and can all be of the same construction. The interchangeability of bolts 26, 28 and 30 and releasable pin member 32 helps reduce the number of different parts which the contractor must carry in inventory and simplifies the erection of scaffold 10 on a scaffold anchor.

A number of rails 34 are attached horizontally to the rail post 24 to enclose the scaffold 10 for purposes of safety. Fixed to the top of the horizontal member 20 are a number of scaffold planks 36 which are likewise substantially horizontal and form a floor for the scaffold 10.

The method of folding the scaffold 10 is made clear by a comparison of FIGS. 1, 3 and 4. The releasable pin member 32, which locks horizontal member 20 and support member 22 at a predetermined angle, is removed, which allows the rail post 24 to be rotated downwardly, as viewed in FIG. 3. The bolt 30 is also removed so that the support member 22 is allowed to pivot with respect to horizontal member 20 and rail post 24 (FIG. 3). Horizontal member 20 is then pivoted to a second position in which horizontal member 20, support member 22, and rail post 24 are closely approximated with gangform 12 (FIG. 4). Thus, when the gangform 12 is disassembled for moving, the scaffold 10 lies flat against the side of the stud 14 to expedite moving of the gangform 12. Also, since the scaffold 10 is closely approximated with the side of the gangform 12, a number of gangforms 12 can be stacked on top of each other for storage, with the scaffold 10, having the rail post 24, rails and scaffold planks 36 attached thereto, remaining in place on each of the gangforms 12.

Although the invention has been described in the above preferred embodiment, it is understood that the variations and modifications which may occur to those skilled in the art who have the benefit of this disclosure would fall within the scope of the following claims.

What is claimed is:

1. A foldable scaffold comprising:

a scaffold anchor;

a horizontal member pivotally mounted at one end to said scaffold anchor;

a support member pivotally mounted at one end to said horizontal member and releasably mounted to said scaffold anchor at the other end;

means for selectively holding said horizontal member in a first substantially horizontal position and for releasing said horizontal member from said first position to allow said horizontal member and said support member to pivot to a second position in which said horizontal member and said support member are closely approximated with said scaffold anchor; and a rail post pivotally mounted at one end to said horizontal member and said support member and supported in a substantially vertical position by said horizontal member holding means.

2. The foldable scaffold of claim 1 wherein said horizontal member holding means comprises a pin and holes in said horizontal member and said support member, said holes being aligned and said pin being received within said aligned holes when said horizontal member is in said first position.

3. The foldable scaffold of claim 1 wherein said horizontal member holding means comprises a pin and holes in said support member and said scaffold anchor, said holes being aligned and said pin being received within said aligned holes when said horizontal member is in said first position.

4. The foldable scaffold of claim 1 wherein said rail post is pivoted to a second position closely approximated with said scaffold anchor when said horizontal member and said support member are in said second position.

5. The foldable scaffold of claim 1 additionally comprising a second horizontal member, a second support member, and a scaffold plank mounted to said horizontal member and to said second horizontal member.

6. The foldable scaffold of claim 5 additionally comprising a second rail post pivotally mounted at one end to said second horizontal member and said second support member, and a rail mounted to said first and second rail posts.

7. The foldable scaffold of claim 6 wherein said rail post is supported in a substantially vertical position by said horizontal member holding means.

8. A method of supporting a scaffold comprising:

pivotally mounting a substantially horizontal member for supporting the planks of a scaffold thereon to a scaffold anchor;

supporting the horizontal member and a rail post with a support member pivotally mounted to the horizontal member at one end the horizontal member being releasably mounted to the scaffold anchor at the other end;

pinning the horizontal member and the support member to each other, thereby locking the horizontal member and the support member in a predetermined angle whereby the horizontal member is substantially horizontal, the support member is mounted to the scaffold anchor and the rail post is supported in a substantially vertical position;

removing the pin and releasing the support member from the scaffold anchor; and pivoting the horizontal member, the rail post, and the support member to a position in which the horizontal member, the rail post, and the support member are closely approximated with the scaffold anchor.

9. A foldable scaffold comprising:

a scaffold anchor;

a horizontal member pivotally mounted at one end to said scaffold anchor;

a support member pivotally mounted at one end to said horizontal member and releasably mounted to said scaffold anchor at the other end;

a rail member pivotally mounted to said horizontal member and said support member; and means for selectively holding said horizontal member in a first substantially horizontal position, said horizontal member holding means also being operable to hold said rail member in a substantially vertical position, and for releasing said horizontal member from said first position to allow said horizontal member, said rail member and said support member to pivot to a second position in which said horizontal member, said rail members and said support member are closely approximated with said scaffold anchor.

10. The foldable scaffold of claim 9 wherein said horizontal member holding means comprises a pin and holes in said horizontal member, said rail member, said support member, and said scaffold anchor, said holes being aligned and said pin being received within said aligned holes when said horizontal member is in said first position.

* * * * *